US008060995B2

(12) United States Patent
Issler

(10) Patent No.: US 8,060,995 B2
(45) **Date of Patent: *Nov. 22, 2011**

(54) CLOSING SYSTEM

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 928 days.

This patent is subject to a terminal disclaimer.

(21) Appl. No.: 11/521,119

(22) Filed: Sep. 14, 2006

(65) Prior Publication Data

US 2007/0006430 A1 Jan. 11, 2007

Related U.S. Application Data

(63) Continuation-in-part of application No. 11/030,519, filed on Jan. 6, 2005, now Pat. No. 7,392,573, which is a continuation of application No. 10/625,967, filed on Jul. 24, 2003, now Pat. No. 7,069,626.

(51) Int. Cl.
*A43C 7/00* (2006.01)

(52) U.S. Cl. ..... 24/714.6

(58) Field of Classification Search ..... 24/714.8–715.2, 24/713.9–714.5, 714.6, 598.5, 598.6; 36/50.1
See application file for complete search history.

(56) References Cited

U.S. PATENT DOCUMENTS

| | | | | |
|---|---|---|---|---|
| 449,273 | A | 3/1891 | Raymond | 24/714 |
| 835,068 | A | 11/1906 | Johnston | 24/714 |
| 876,341 | A | 1/1908 | Forstner | 24/683 |
| 887,942 | A | 5/1908 | Houghland | 24/714 |
| 888,454 | A | 5/1908 | Almy | 24/714 |
| 991,443 | A | 5/1911 | Heath | 24/714 |
| 1,548,407 | A | 8/1925 | Chisholm | 24/714 |
| 1,995,243 | A | 3/1935 | Clarke | 24/713 |
| 2,913,793 | A | 12/1959 | Tallarico | 24/713 |
| 3,038,171 | A | 6/1962 | Barolucci et al. | 4/503 |
| 3,197,833 | A | 8/1965 | Putthuf | 36/54 |
| 4,389,736 | A * | 6/1983 | Clifton | 2/328 |
| 4,507,878 | A | 4/1985 | Semouha | 36/50 |
| 5,109,581 | A | 5/1992 | Gould | 24/714 |
| 5,347,695 | A | 9/1994 | Lopez Saiz | 24/714 |
| 5,379,496 | A | 1/1995 | Krauss | 24/625 |
| 5,755,044 | A | 5/1998 | Veylupek | 36/501 |
| 5,894,640 | A * | 4/1999 | Dewey | 24/306 |
| 6,219,891 | B1 * | 4/2001 | Maurer et al. | 24/713.2 |
| 6,240,657 | B1 | 6/2001 | Weber et al. | 36/50 |
| D462,162 | S | 9/2002 | Peng | D2/978 |
| 6,568,104 | B2 | 5/2003 | Liu | 36/50 |

* cited by examiner

FOREIGN PATENT DOCUMENTS

WO WO 97/40718 11/1997

*Primary Examiner* — Jack W. Lavinder
(74) *Attorney, Agent, or Firm* — St. Onge Steward Johnston & Reens, LLC

(57) ABSTRACT

A closing system having an item to be closed and opened, a clasp, and a receiver. The clasp has an anchoring end and a lace end, where the lace end is adapted to hold a part of the item and the anchoring end includes a first part and a second part that are movable away from and toward one another. The receiver includes a first receptacle and a second receptacle for engaging the first and second parts, respectively, where the receiver is a removably attachable mechanism. The clasp is removably joinable to the receiver when the first and second parts are engaged with the first and second receptacles and, when the first and second parts are disengaged with the first and second receptacles, the clasp is separable from the receiver. The first and second parts are movable away from one another and the receiver is removably attached to the item.

5 Claims, 16 Drawing Sheets

CLOSING SYSTEM

CROSS-REFERENCE TO RELATED APPLICATIONS

This application is a continuation-in-part of U.S. patent application Ser. No. 11/030,519 filed Jan. 6, 2005, now U.S. Pat. No. 7,392,573, which application is a continuation of U.S. patent application Ser. No. 10/625,967 filed Jul. 24, 2003, now U.S. Pat. No. 7,069,626 issued on Jul. 4, 2006.

FIELD OF THE INVENTION

The invention relates to an improved closing system for closing any item, such as luggage, bags, or compartments where laces, zippers, or other closing mechanisms are conventionally used.

BACKGROUND OF THE INVENTION

Luggage, back packs, garment bags, brief cases, and other items that are typically opened and closed often employ closing mechanisms such as zippers, buttons, clasps, ties, or other similar closing devices.

In an item that typically employs laces or ties, opening and closing the item would usually involve tying and untying the laces or ties each time the item was opened or closed. This repetition is often exacerbated should the item to be closed be tied or laced too tightly or too loosely, which often results in untying and retying the laces or ties to the proper fit. Moreover, tying and retying an item each time it was to be opened or closed generally involved a lengthy period of time.

For other items to be opened and closed, buttons may be used instead of laces or ties. Although buttons may reduce or eliminate the occurrence of the item being closed too tightly or too loosely, the time spent to button and unbutton the item was often as lengthy or more lengthy than the time spent to lace and unlace an item. In some situations, buttoning the item took longer than tying it because there may be multiple buttons where a single lace or tie may be used in its place. Moreover, buttons may be accidentally broken or lost and difficult to replace as it usually entails sewing the buttons on one at a time. On the other hand, laces or ties are often less prone to breakage and replacing a lace is generally easier than sewing multiple buttons in place.

Zippers are another type of closing mechanism that may be used in place of buttons or laces. Zippers tend to allow easier and quicker closing and/or opening of an item over laces, ties, or buttons. Although zippers are generally sturdy, once broken, zippers tend to be difficult to replace as sewing is generally needed. Moreover, based on the toughness and thickness of a zipper together with the item, sewing a zipper may also entail use of a sewing machine, which may present a problem if a sewing machine is not available. In some cases, an industrial grade sewing machine is typically used to sew the zipper to the item. Such industrial sewing machines may be similar to those used to sew riding saddles for horses.

U.S. Pat. No. 1,995,243 to Clarke, U.S. Pat. No. 991,443 to Heath, U.S. Pat. No. 462,162 to Peng, and U.S. Pat. No. 887,942 to Houghland typically involve the use of laces or ties. Opening and closing the items appear to require the laces or ties to be tied and untied each time the shoe is to be worn or removed.

U.S. Pat. No. 4,507,878 to Semouha patent also appears to use laces or ties to open and close a shoe. Although the laces do not appear to be tied or untied each time the shoe is to be worn or removed, the laces seem to be slid downward toward the ankle area of the shoe. In this position, a user's foot may be slipped in and out of the shoe, which may prove uncomfortable since the foot is squeezed each time it passes through the ankle area of the shoe. This problem may be even more troublesome should a user's foot be large or should the user have difficulty maneuvering his/her foot through what is believed to be a generally tight channel.

U.S. Pat. No. 5,347,695 to Lopez Saiz patent seems to relate to a device that facilitates repeated opening and closing of a shoe. However, the device appears to be easily dislodged from the shoe and, therefore, may permit the shoe to be accidentally untied or opened.

What is desired, therefore, is a closing mechanism that permits repetitive opening and closing of an item. Another desire is a closing mechanism that permits faster opening and closing of an item over conventional closing mechanisms. A further desire is a closing mechanism that resists breakage and, if breakage should occur, is easy to replace onto the item.

SUMMARY OF THE INVENTION

Accordingly, it is an object of the invention to provide a closing mechanism that facilitates opening and closing of an item.

It is another object of the invention to provide a closing mechanism that consistently opens and closes an item with improved repeatability.

It is another object of the invention to provide a closing mechanism with low cost and that is easily replaced.

These and other objects of the invention are achieved by a closing system having an item to be closed and opened, a clasp, and a receiver. The clasp has an anchoring end and a lace end, where the lace end is adapted to hold a part of the item and the anchoring end includes a first part and a second part that are movable away from and toward one another. The receiver includes a first receptacle and a second receptacle for engaging the first and second parts, respectively, where the receiver is a removably attachable mechanism. The clasp is removably joinable to the receiver when the first and second parts are engaged with the first and second receptacles and, when the first and second parts are disengaged with the first and second receptacles, the clasp is separable from the receiver. The first and second parts are, when an opening force is applied to said clasp, moved away from one another and wherein the receiver is removably attached to the item.

In some embodiments, the first and second parts are biased toward one another such that, when the opening force is removed, the first and second parts automatically move toward one another.

In other embodiments, the item is selected from the group consisting of a belt, a luggage, a jacket, a pair of pants, a pair of gloves, a pair of mittens, a book bag, a brief case, a duffle bag, a hat, a pair of overalls, a cabinet, and combinations thereof.

In further embodiments, the receiver is selected from the group consisting of a button, hook, hook and loop fastener, and combinations thereof. Optionally, the button is a snap button or is insertable.

In another aspect of the invention, a method for providing a closing system includes the steps of providing an item to be closed and opened, providing a clasp having a receiver end and a lace end, extending a first part and a second part from the receiver end, and extending a holder from the lace end. The method also includes the step of providing a receiver having a first receptacle and a second receptacle for receiving the first and second parts, respectively, wherein the receiver is a removably attachable mechanism. The method also removably attaches the receiver to the item and moves the first and second parts toward one another and into the first and second receptacles, respectively, to removably join the clasp with the receiver, wherein the clasp is removably joinable to the receiver for closing an item and the clasp is separable from the receiver for opening the item.

In some embodiments, the method further includes the step of moving the first and second parts away from one another and out of the first and second receptacles, respectively, to separate the clasp from the receiver. In other embodiments, the method selects the item from the group consisting of a luggage, a jacket, a pair of pants, a pair of gloves, a pair of mittens, a book bag, a brief case, a duffle bag, a hat, a pair of overalls, a cabinet, a belt, and combinations thereof.

In further embodiments, the method includes the receiver being selected from the group consisting of a button, hook, and combinations thereof.

In another aspect of the invention, a closing system provides an item to be closed, where the item is selected from the group consisting of a belt, a luggage, a jacket, a pair of pants, a pair of gloves, a pair of mittens, a book bag, a brief case, a duffle bag, a hat, a pair of overalls, a cabinet, and combinations thereof. The closing mechanism includes a clasp having an anchoring end and a lace end, where the lace end adapted to hold a lace of the item and the anchoring end has a first part and a second part where the first and second parts are movable away from and toward one another. The closing system also includes a receiver having a first receptacle and a second receptacle for engaging the first and second parts, respectively, where the receiver is a removably attachable mechanism selected from the group consisting of a button, hook, hook and loop fastener, and combinations thereof. Wherein the clasp is removably joinable to the receiver when the first and second parts are engaged with the first and second receptacles and, when the first and second parts are disengaged with the first and second receptacles, the clasp is separable from the receiver. Wherein the first and second parts are, when an opening force is applied to the clasp, moved away from one another and wherein the receiver is removably attached to the item.

DETAILED DESCRIPTION

Belts includes tool belts. Button includes snap on and ones pushed through slots.

Figure 1:
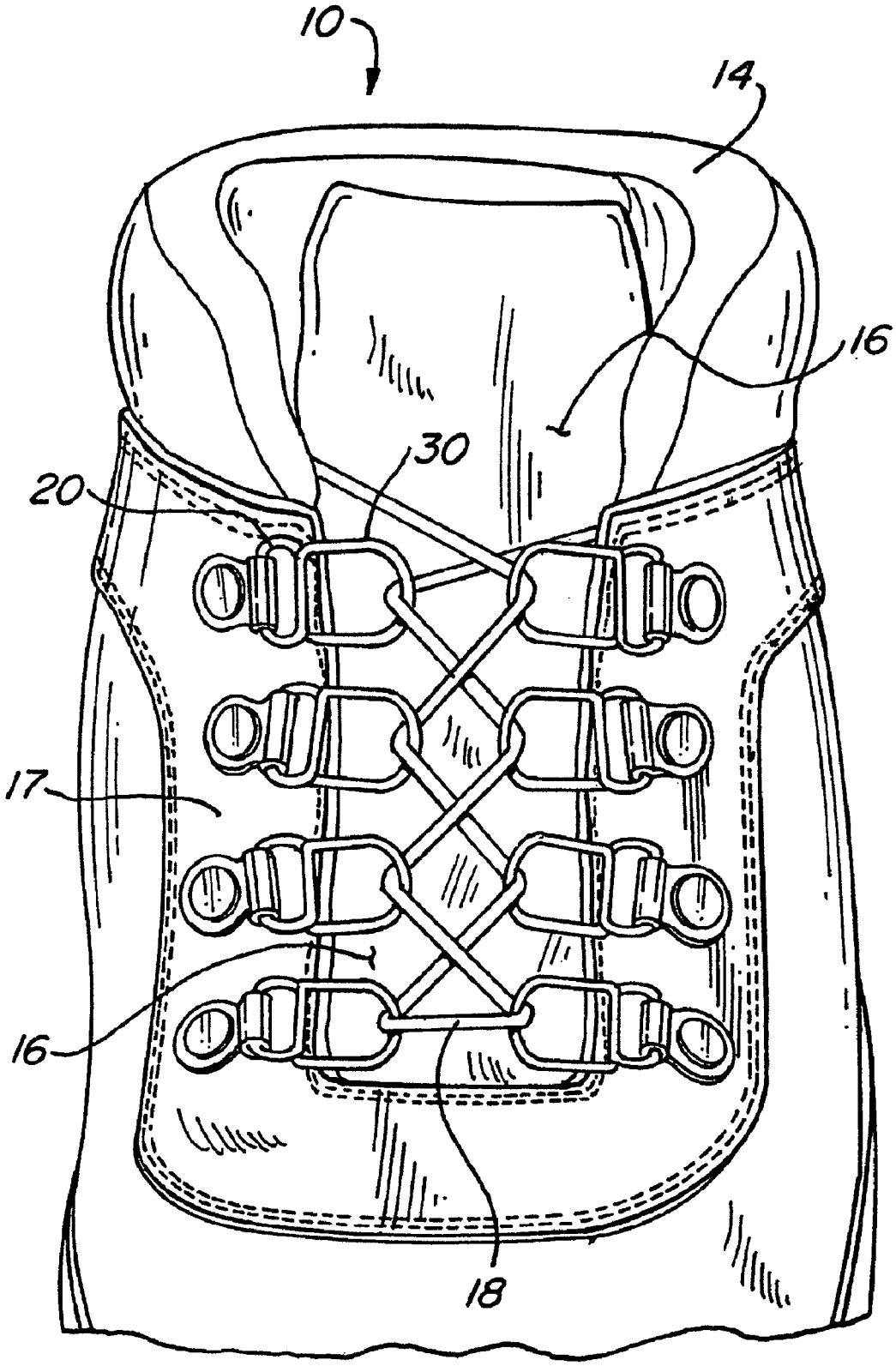
FIG. 1 depicts the closing system in accordance with the invention.

FIG. 1 depicts the improved lacing system 10 in accordance with the invention. Lacing system 10 includes receiver 20 and clasp 30, where receiver 20 and clasp 30 operate in cooperation with one another for opening and closing item 14. Due to the size of aperture 16, multiple receivers 20 and clasps 30 may be used. For a small aperture, as few as one receiver and one clasp may be used. The quantity of receivers and clasps should be a limitation of the invention. Receiver 20 and clasp 30 further facilitate repetitive opening and closing, while reducing the time spent opening and closing, item 14. Moreover, receiver 20 and clasp 30 permit a user to repeatedly close item 14 with the same or similar degree of tension in lace 18, which is particularly beneficial if item 14 is a shoe, article of clothing, or other apparatus where proper and consistent fit are desired.

As shown, receiver 20 is secured to a side 17 of an aperture 16 of item 14 and, to close aperture 16, clasp 30 and, therefore, lace 18 are joined to receiver 20. Releasing clasp 30 from receiver 20 opens aperture 16. By releasing clasp 30 from receiver 20, lace 18 is also removed without necessitating that lace 18 be untied or removed from clasp 30. Therefore, rejoining clasp 30 to receiver 20 not only closes aperture 30, but provides consistent tension to lace 18 after clasp 30 is joined to receiver 20. Hence, the invention facilitates opening and closing aperture 16 while providing consistent, or repeatable, tension to lace 18 and obviating the occurrence of item 14 being closed too tight or loose.

Figure 2A:
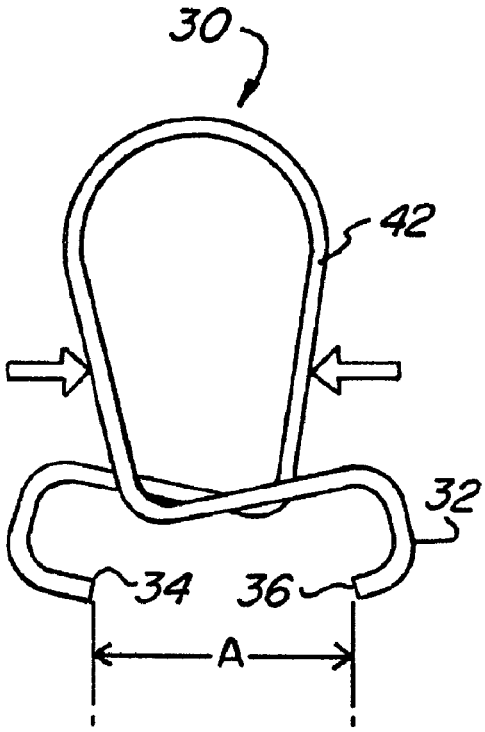
FIG. 2*a* depicts a top view of a clasp shown in FIG. 1.
Figure 2B:
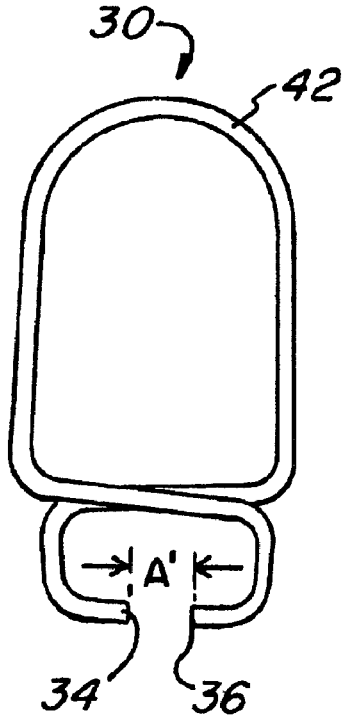
FIG. 2*b* depicts another top view of a clasp shown in FIG. 1.

FIGS. 2*a* and 2*b* more particularly depict clasp 30 in accordance with the invention. FIG. 2*a* shows clasp 30 in the open position and FIG. 2*b* shows clasp 30 in its original, resting position. FIG. 2*a* shows first part 34 and second part 36 of anchoring end 32 being moved away from one another by an opening force being applied to lace end 42, as shown. Upon lace end 42 being compressed, first and second parts 34, 36 are moved away from one another. For exemplary purposes, first and second parts 34, 36 are shown separated from one another at a distance A.

Clasp 30 is made of a material having an elastic characteristic so that, when the opening force is removed, clasp 30 returns to its original shape, shown in FIG. 2*b*, which is also the closed position of clasp 30. Upon removal of the opening force, lace end 42 expands from its compressed position shown in FIG. 2*a* and, as a result, first part 34 and second part 36 also return to their original shape by moving toward one another. First and second parts 34, 36 automatically move toward one another upon the opening force being removed and automatically stop at distance A'. As can be seen, distance A is greater than distance A' and both distances may be any arbitrarily picked number. All that is required is that distance A be greater than receiver length L and distance A' be smaller than receiver length L so that clasp 30 may be engaged and disengaged with receiver 20. The distances A, A' in relation to length L are described in more detail below.

The material for clasp 30 may be any material that permits first and second parts 34, 36 to be moved away from one another upon a compressive force being applied to lace end 42 and having sufficient elasticity so that, when the compressive force is removed from lace end 42, first and second parts 34, 36 automatically move toward one another. For exemplary purposes, stainless steel, steel, plastic, fiberglass, and combinations thereof are just some possibilities of the material of clasp 30.

Figure 6A:
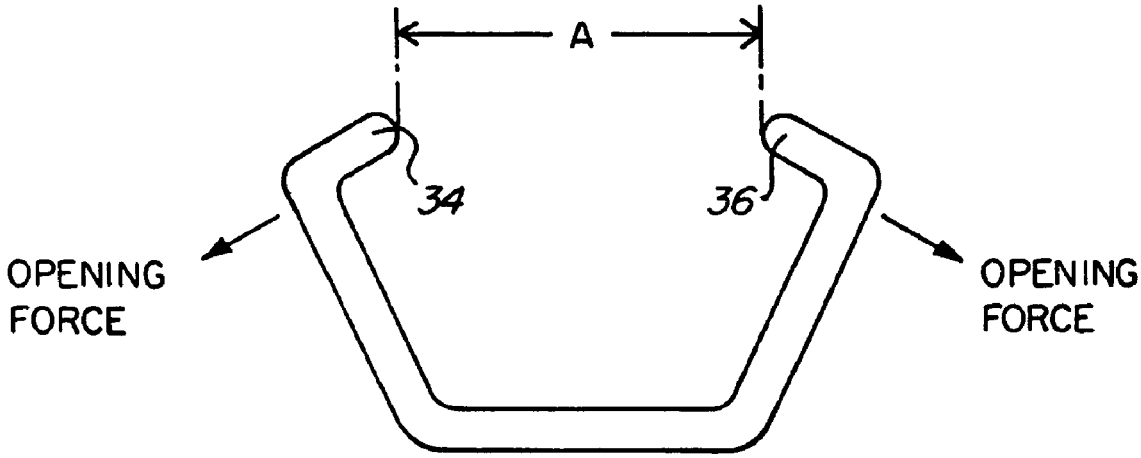
FIG. 6*a* depicts another embodiment of the clasp shown in FIG. 1.
Figure 6B:
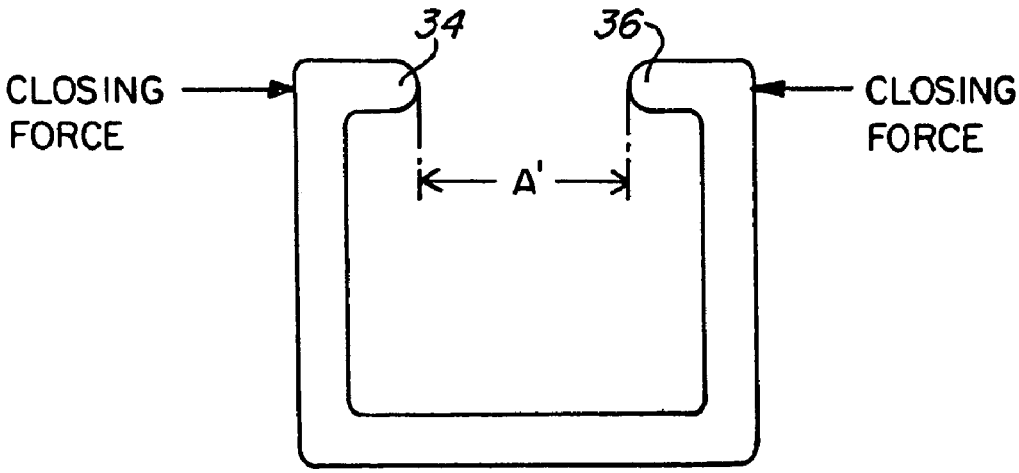
FIG. 6*b* depicts another embodiment of the clasp shown in FIG. 1.

In another embodiment of clasp 30, shown in FIG. 6*a* the material is not elastic but is permanently deformed each time first and second parts 34, 36 are either moved away from or toward one another. In this embodiment, when first and second parts 34, 36 are moved away from one another to the position shown in FIG. 2*a* and by an opening force, first and second parts 34, 36 remain in this position even when the opening force is removed. Hence, first and second parts 34, 36 do not automatically move back toward one another, as described under FIGS. 2*a* and 2*b*. A closing force, shown in FIG. 6*b*, will be used to move first and second parts 34, 36 toward one another.

In this embodiment, first and second parts 34, 36 open and close to engage and disengage from receiver 20 but, because of the non elastic nature of the material of clasp 30, various other geometries of clasp 30 may be employed that may be easier or less expensive than the embodiment of FIGS. 2*a* and 2*b*.

Figure 3A:
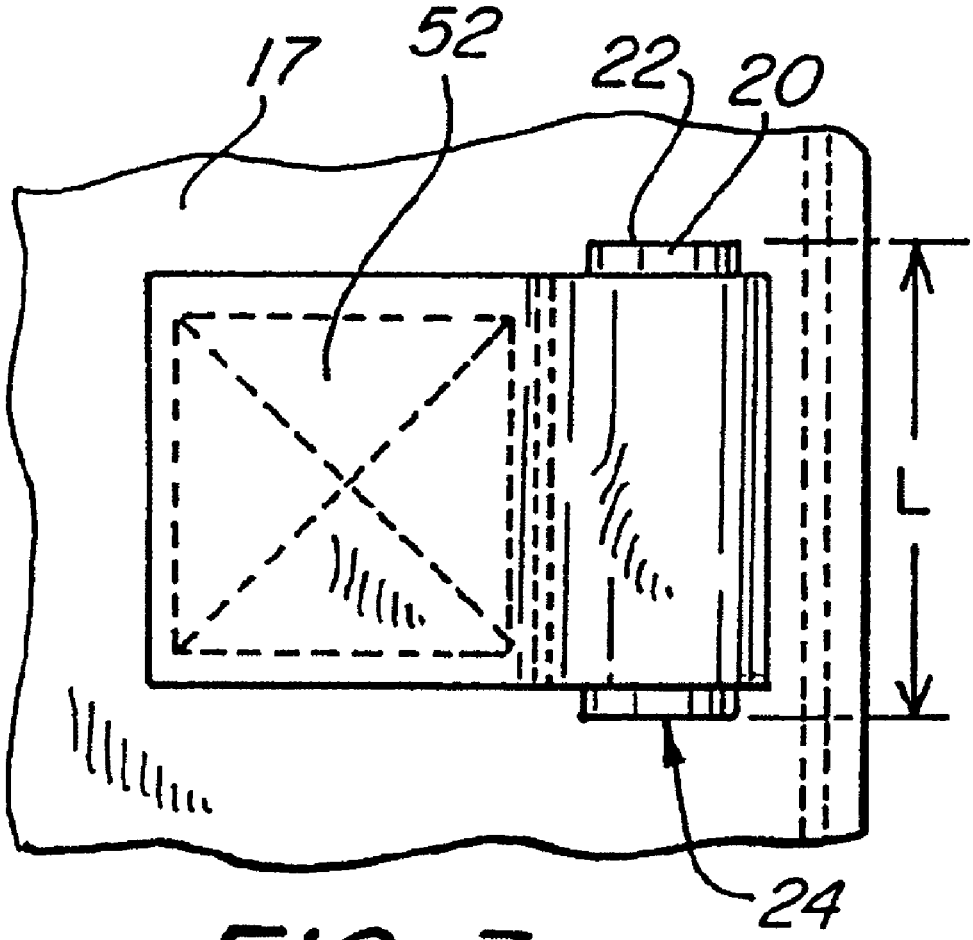
FIG. 3*a* depicts a top view of a receiver shown in FIG. 1.
Figure 3B:
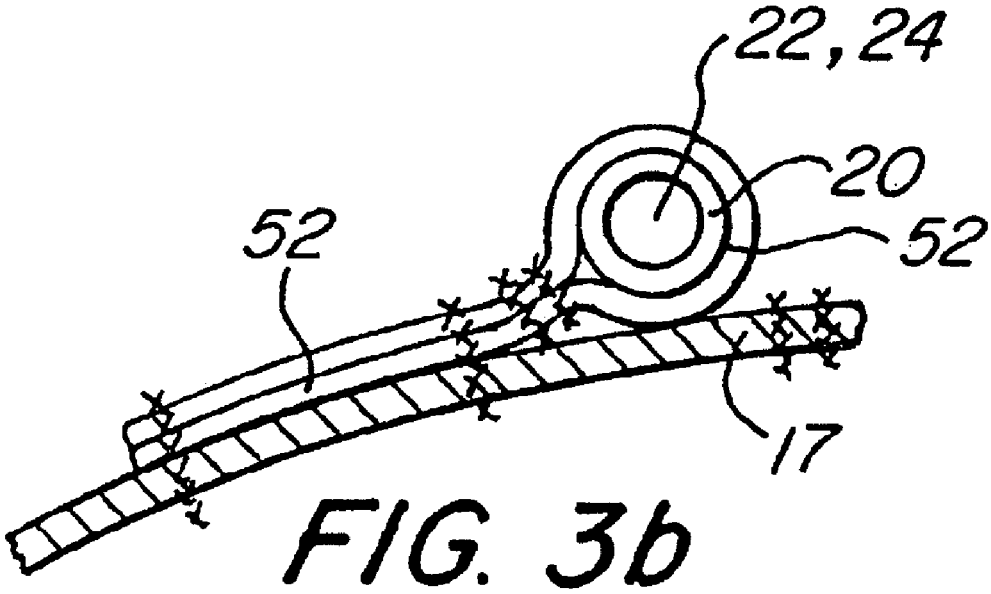
FIG. 3*b* depicts a side view of a receiver shown in FIG. 1.

FIGS. 3*a* and 3*b* show a top view and side view, respectively, of receiver 20. As shown, receiver 20 is a cylinder having open ends that act as first and second receptacles 22, 24 for receiving first and second parts 34, 36, respectively. Once first and second parts 34, 36 are engaged with, or received into, first and second receptacles, clasp 30 is joined or secured, albeit removably joined or secured, to receiver 20. As shown, receiver 20 has a length L and for clasp 30 to be removably joined to receiver 20, first and second parts 34, 36 are moved away from one another at a distance A, where distance A is greater than length L. Clasp 30 is then moved so that receiver 20 is between first and second parts 34, 36 and then first and second parts 34, 36 are moved toward one another to the closed position, whether automatically as in FIG. 2*b* or by the manual closing force of FIG. 6*b*. In the closed position, shown in FIG. 2*b* or FIG. 6*b*, first and second parts 34, 36 are separated by a distance A', where A' is smaller than length L, and results in first and second parts 34, 36 being engaged with, or received into, first and second receptacles 22, 24. To disengage clasp 30 from receiver 20, first and second parts 34, 36 are moved away from one another and clasp 30 is moved away from receiver 20.

In another embodiment of receiver 20, receiver 20 is a solid shaft with bored ends. In further embodiments, receiver 20 is a hollow cylinder, which obviates the need to bore the ends of receiver 20 to provide first and second receptacles 22, 24. All that is required is receiver 20 have open ends to engage or receive first and second parts 34, 36.

Receiver 20 is attached to item 14 in any of the following possible embodiments. As shown, receiver 20 is glued to strap 52, which is sewn to side 17 of aperture 16. In addition or instead of being glued to strap 52, receiver may be sewn to strap. Receiver 20 may optionally be flanged at the opposite ends to help prevent receiver 20 from sliding out of pocket 54 of strap 52.

Figure 4A:
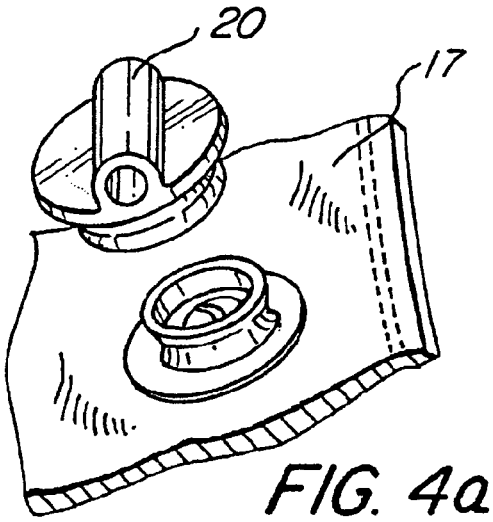
FIGS. 4*a*-4*e* depict various embodiments of attaching a receiver to the items shown in FIG. 1.

In another embodiment, shown in FIG. 4*a*, receiver 20 is attached to a button half, which mates with a mating button half located on side 17 of aperture 16. In this embodiment, receiver 20 is removably joined to item 14. FIG. 4*d* shows a variation of the receiver shown in FIG. 4*a* where receiver 20 is attached to one side of the button half.

Figure 4B:
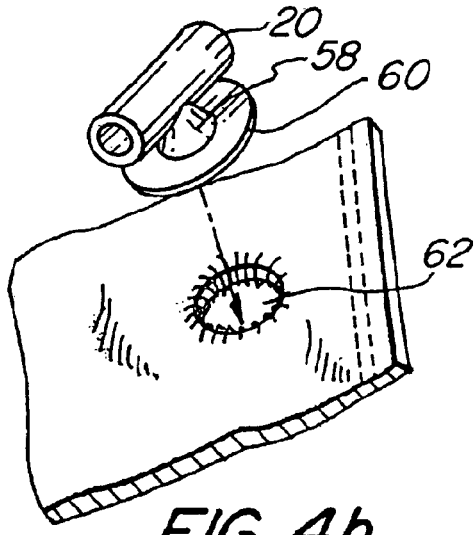

FIG. 4*b* shows yet another embodiment of attaching receiver 20 to item 14 where receiver 20 is attached to or integrally formed with protrusion 58. Protrusion 58 is inserted into eyelet 62, or other opening, of item 14. The mushroom shaped head 60 of protrusion 58 helps maintain protrusion 58 in eyelet 62. In this embodiment, receiver 20 is also removably joined to item 14 by merely inserting and pulling protrusion 58 in and out of eyelet 62.

Figure 4C:
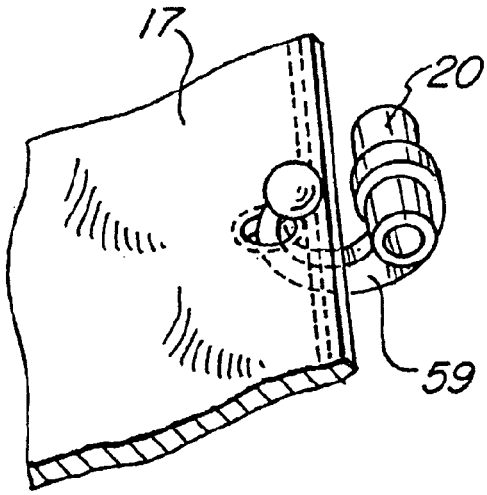
Figure 4D:
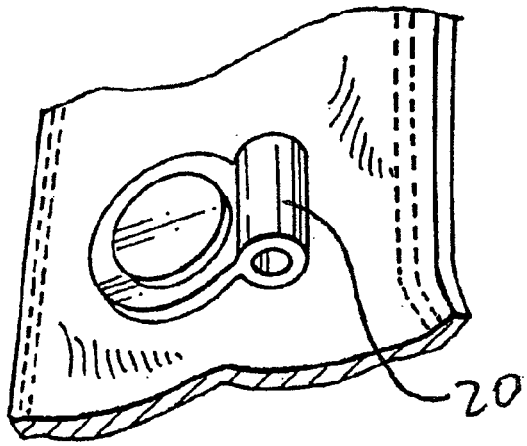

In another embodiment, shown in FIG. 4*c*, receiver 20 is attached to or integrally formed with a protrusion 59 and protrusion 59 is hook-shaped. Protrusion 59 is insertable into eyelet 62 and the hook-shaped geometry helps prevent protrusion 59 from accidentally being removed from eyelet 16. In this embodiment, receiver 20 is also removably joined to item 14.

Figure 4E:
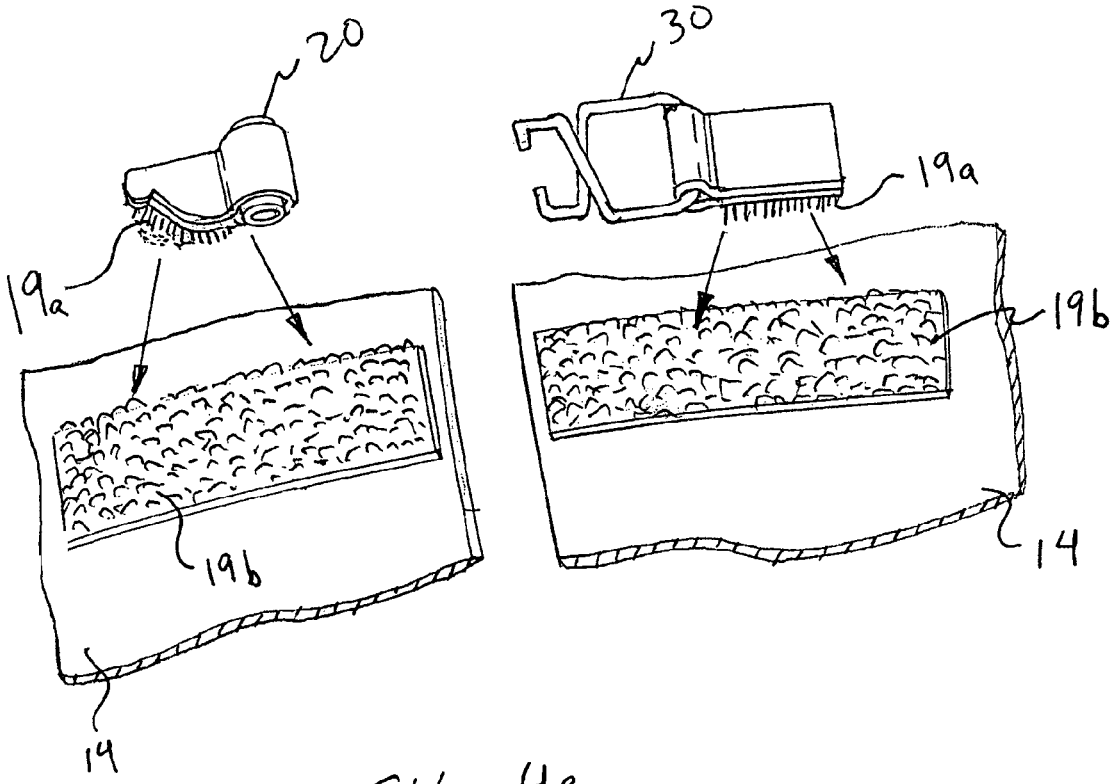

In yet another embodiment, shown in FIG. 4*e*, receiver 20 and clasp are each attached to item 14 via hook 19*a* and loop 19*b* fastener. In this fashion, receiver 20 and clasp 30 are removably attached to item 14 in various locations along loop 19*b* of the hook and loop fastener, which may be advantageous if item 14 is an article of clothing and adjusting fit is desired. Further, if item 14 is a luggage or purse, an adjustable closing mechanism is desired when the luggage or purse is near maximum capacity.

Item 14 may be any article that can be opened and closed by clasp 30 in cooperation with receiver 20. The following is a non-exhaustive list of possibilities for item 14 that may employ the invention. It is understood that the invention is not limited to the items on this list and that item 14 is not a limitation of the receiver 20 or clasp 30, or variations of the receiver 20 or clasp 30 that would be obvious or known to one skilled in the art. The non-exhaustive list of possibilities for item 14 include a shoe, a bag, a compartment, a box, a suitcase, a jacket, a shirt, a pair of pants, a sweater, any article of clothing, and the like. Various applications of the invention are depicted in the embodiments shown in FIGS. 7-18. Clasp 30 and receiver 20 for all embodiments described herein may be used instead of a button, zipper, lace, or tie. Furthermore, it is understood that clasp 30 and receiver 20 as described below include all of the limitations of clasp 30 and receiver 20 described above, and vice versa.

Figure 5:
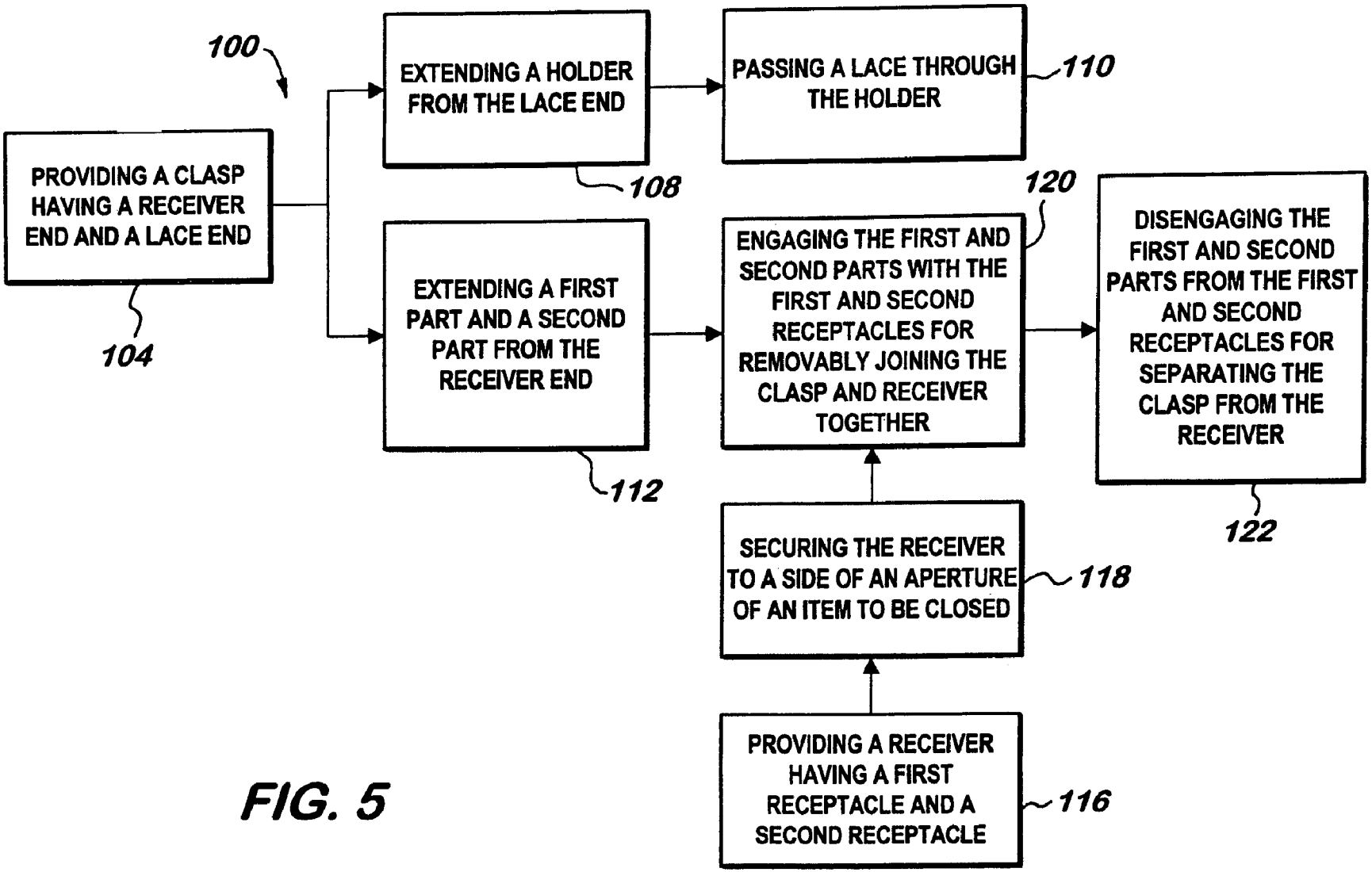
FIG. 5 depicts a method for providing the closing system shown in FIG. 1.

FIG. 5 depicts a method 100 for providing the improved lacing system, including the steps of providing 104 a clasp having a receiver end and a lace end, extending 108 a holder from the lace end for holding a shoe lace, and passing 110 a shoe lace through the holder.

Independent from the step of extending 108 a holder from the lace end, method 100 further includes the step of extending 112 a first part and a second part from the receiver end. Method 100 also provides 116 a receiver having a first receptacle and a second receptacle and secures 118 the receiver to a side of an aperture of an item that is to be opened and/or closed.

To close the item, method 100 engages 120 the first and second parts with the first and second receptacles for removably joining the clasp and receiver together. To open the item, method 100 disengages 122 the first and second parts from the first and second receptacles for separating the clasp from the receiver.

Figure 7:
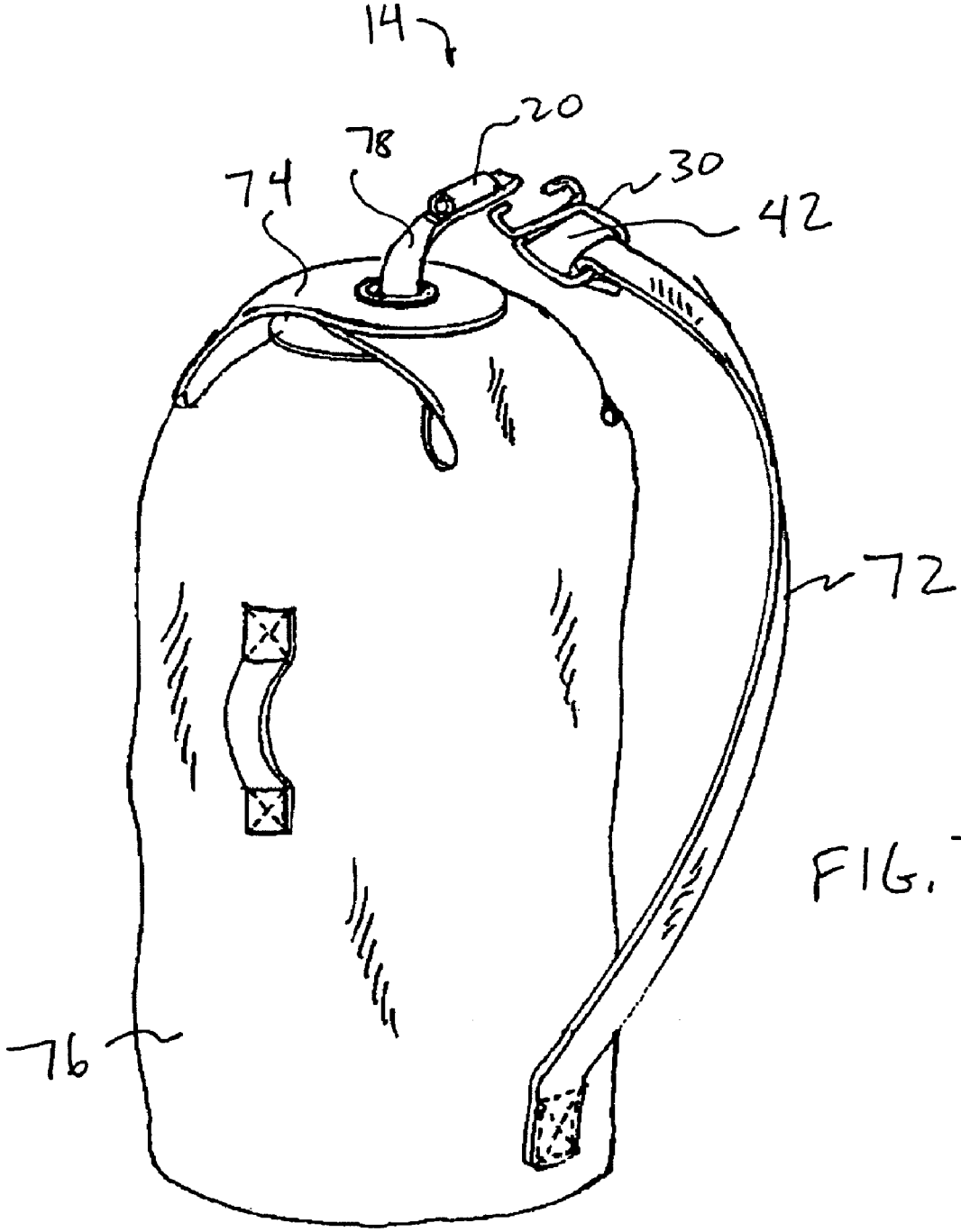
FIGS. 7-18 depict various embodiments of the closing system shown in FIG. 1.

As shown in FIG. 7, item 14 is a duffle bag where clasp 30 and receiver 20 facilitate attachment of shoulder strap 72 and securement of top 74 to body 76 of the duffle bag. For the embodiments shown in FIGS. 7-18, clasp 30 and receiver 20 include all of the limitations described above under FIGS. 1-6*b*. As shown in FIG. 7, shoulder strap 72 is passed through lace end 42 instead of lace 18. Receiver 20 is sewn or otherwise permanently attached to receiver strap 78, which is used to hold top 74 in place positioned above the opening (hidden beneath top 74) of the duffle bag and where securement of top 74 to body 76 via shoulder strap 72, clasp 30, and receiver 20 secures the articles inside the duffle bag.

Figure 8:
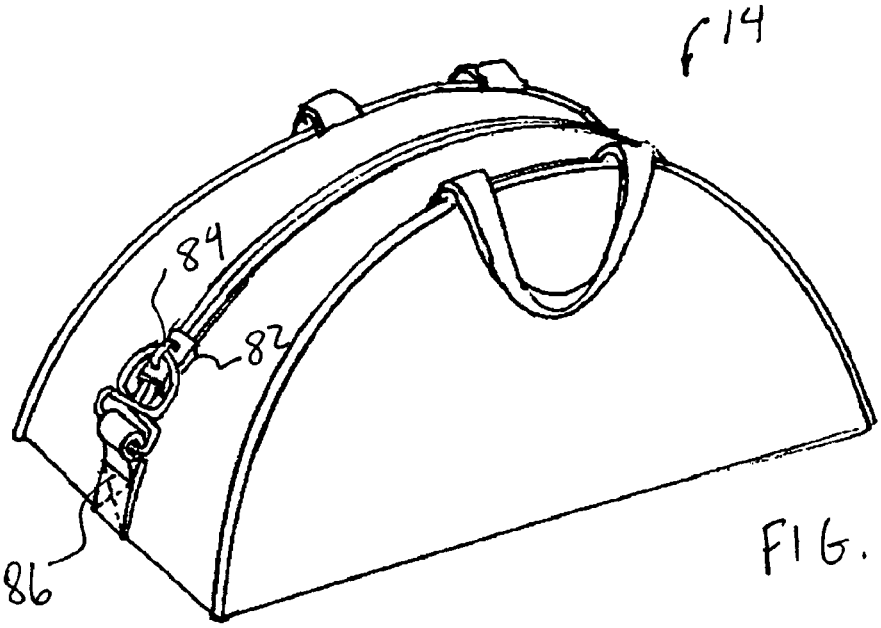

FIG. 8 depicts item 14 as a bowling bag or luggage where claps 30 and receiver 20 essentially locks zipper 82 in place and item 14 in a closed position. As shown, receiver 20 is secured to item 14 or receiver strap 86 while clasp 30 is secured to loop 84 of zipper 82, where handle 84 passes through lace end 42 instead of lace 18.

Figure 9:
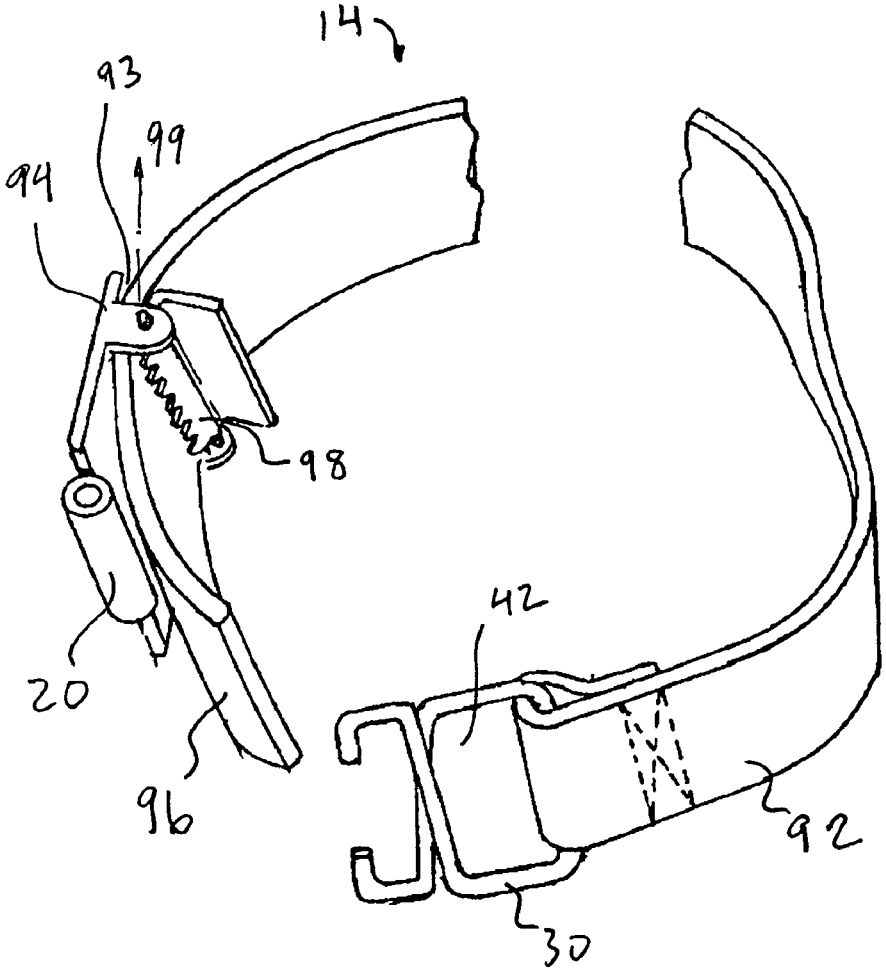

FIG. 9 depicts item 14 as a belt, where clasp 30 and receiver 20 are used to secure a belt to a wearer. Clasp 30 is fixed to distal end 92 and where distal end 92 is formed into a loop and passed through lace end 42 as opposed to lace 18. Receiver 20 is attached to buckle 94 and buckle 94 is removably attached to proximal end 96. As shown, buckle 94 includes teeth 98 for engaging with proximal end 96. Adjustment is made to the belt by disengaging teeth 98 (by rotating teeth 98 about axis 99) from proximal end 96, sliding proximal end 96 through buckle aperture 93 and relative to receiver 20, and re-engaging teeth 98 to proximal end 96 by rotating teeth 98 about axis 99 in an opposite direction than the direction for disengaging teeth 98.

Figure 10:
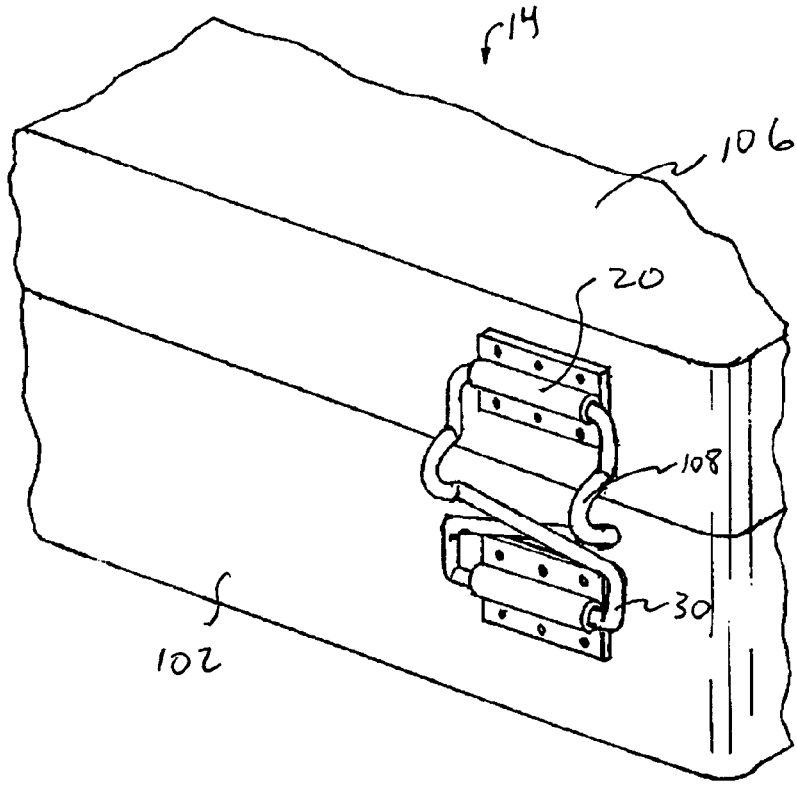

FIG. 10 depicts item 14 as a brief case, suitcase, or otherwise generally rigid container for containing articles. As shown, clasp 30 is secured to bottom 102 of the brief case and receiver 20 is secured to top 106 where securement of clasp 30 to receiver 20 secures top 106 and bottom 102 together. It is understood that clasp 30 may be secured to top 106 and receiver 20 may be secured to bottom 102. Further, in some embodiments, clasp 30 includes bowed shape 108 so that a user may easily manipulate clasp 30. Because item 14 is a generally rigid container, such as a suitcase, numerous clasp 30 and receiver 20 arrangements are not needed along the length of the joint joining top 106 to bottom 102 in order to adequately secure top 106 to bottom 102. In most embodiments, two sets of clasps 30 and receivers 20 suffice per one flat side of item 14.

Figure 11:
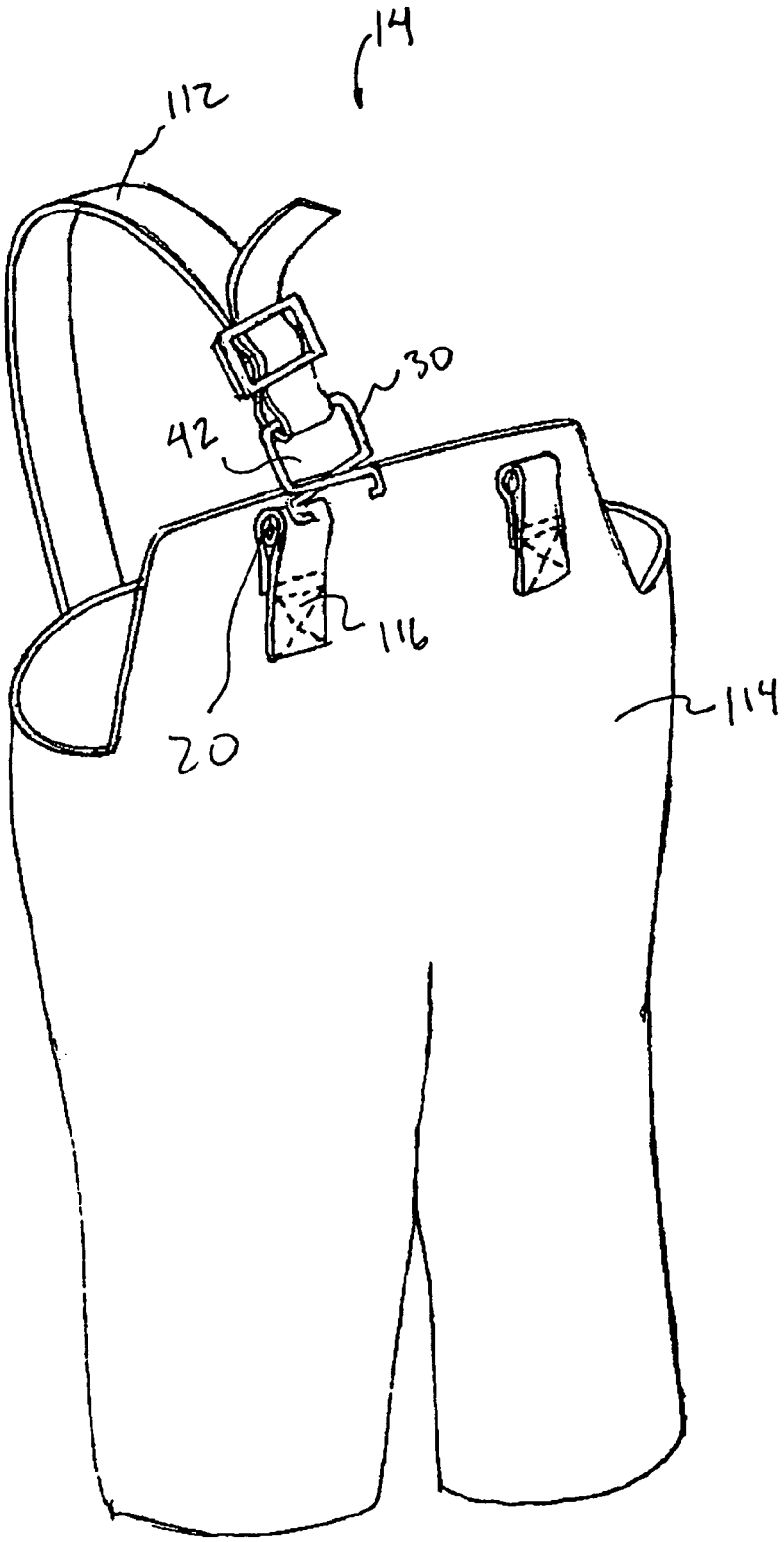

FIG. 11 depicts item 14 as a pair of overalls where clasp 30 is attached to shoulder strap 112 and receiver 20 is secured to receiver strap 116 that in turn is secured to back 114 of overalls. In other embodiments, clasp 30 is located on the front of shoulder strap 112 and secured to receiver 20 on the front (not shown) of the overalls. In these embodiments, clasp 30 and receiver 20 operate to quickly and securely fasten shoulder strap 112 to back 114 or the front of overalls and makes dressing and undressing easier than traditional overalls or snowsuits, which sometimes use a buckle through which shoulder strap 112 is threaded.

Figure 12:
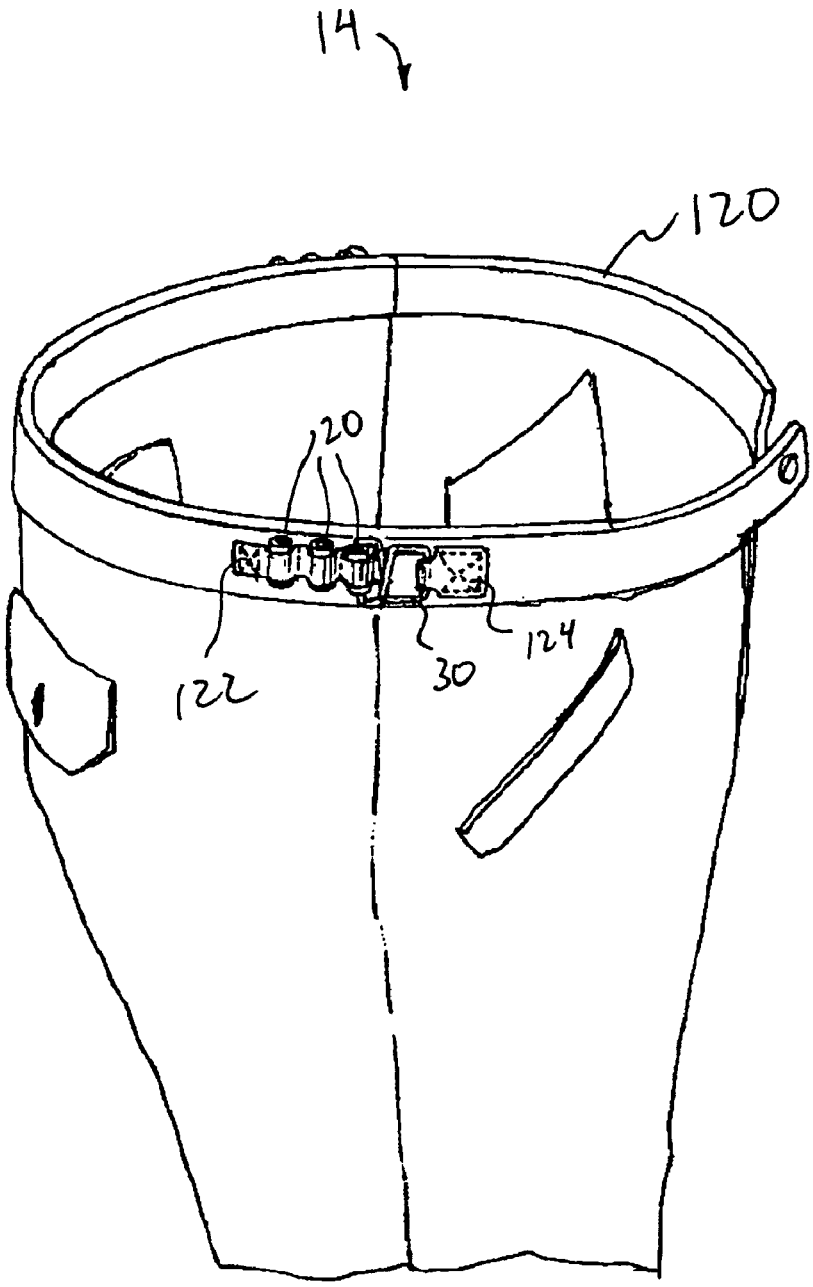

FIG. 12 shows item 14 as adjustable waistband 120 where clasp 30 being attached to one receiver 20 of a plurality of receivers 20 permit the adjustment. By selecting which receiver 20 for clasp 30 to be attached, waistband 120 may be adjusted. As shown, receiver 20 is attached to waistband 120 via receiver strap 122 and clasp 30 is attached to waistband 120 via clasp strap 124.

Figure 13:
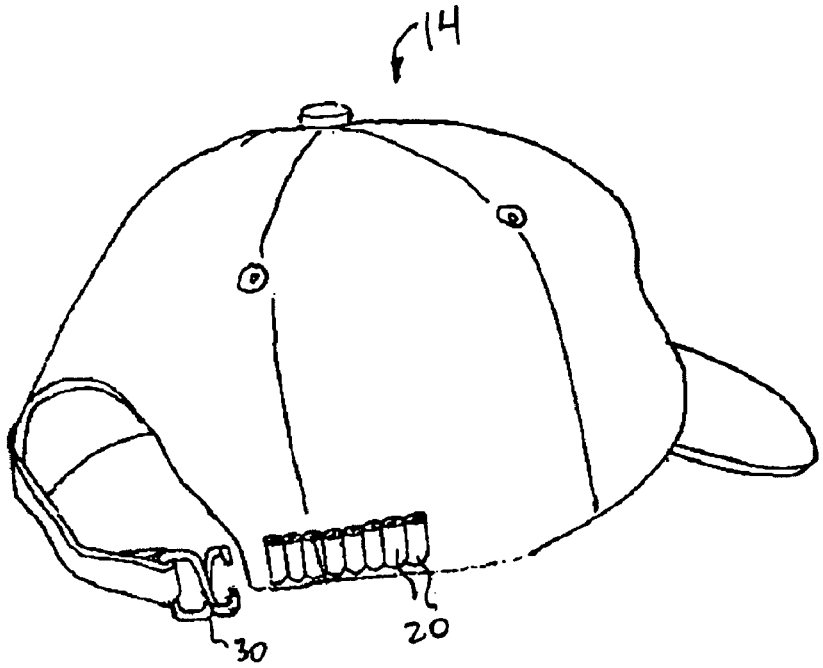

FIG. 13 depicts item 14 as a hat with adjustable headband 128. It operates in the same manner as adjustable waistband 120 shown in FIG. 12 so that the circumference of the hat or fit around a wearer's head is adjustable. As shown, plurality of receivers 20 is attached to the hat.

Figure 14:
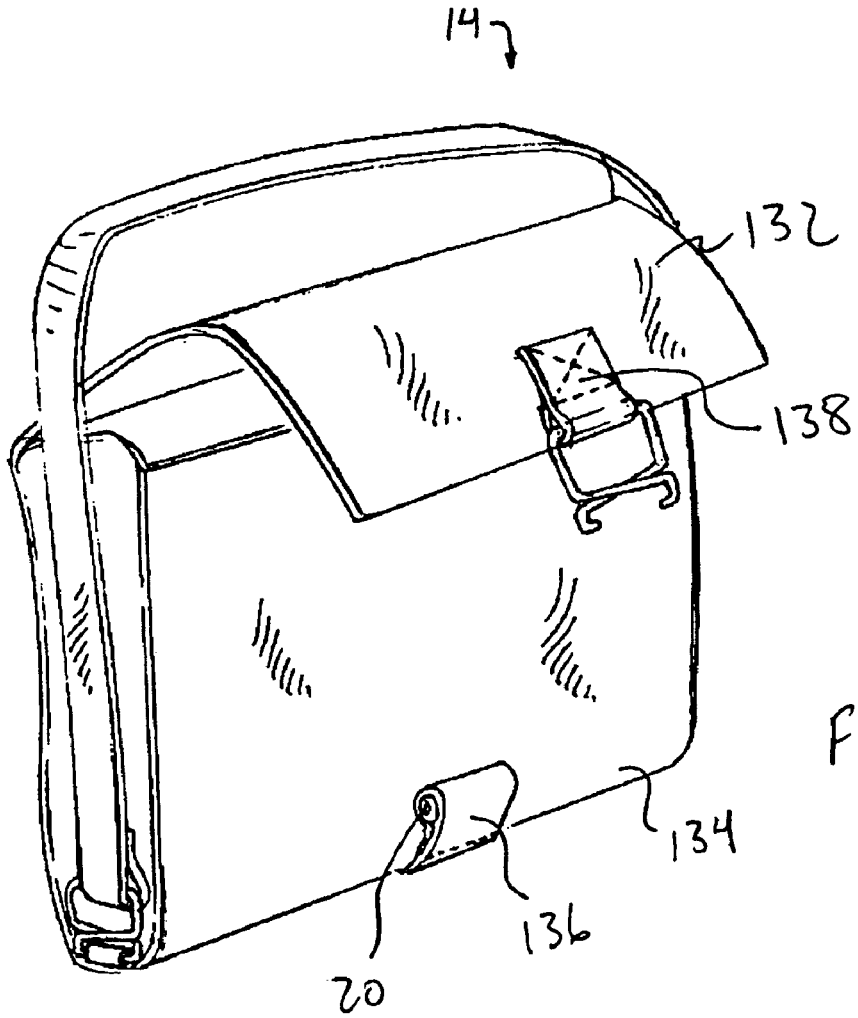

FIG. 14 shows item 14 as a purse utilizing clasp 30 and receiver 20 to secure top 132 to body 134, thereby closing the purse. In other embodiments, item 14 is a shoulder bag, book bag, or soft brief case or any article benefiting from a closing mechanism that facilitates opening and closing. As shown, receiver 20 is attached to receiver strap 136 that in turn is secured to body 134 and clasp 30 is attached to clasp strap 138 that in turn is secured to top 132.

Figure 15:
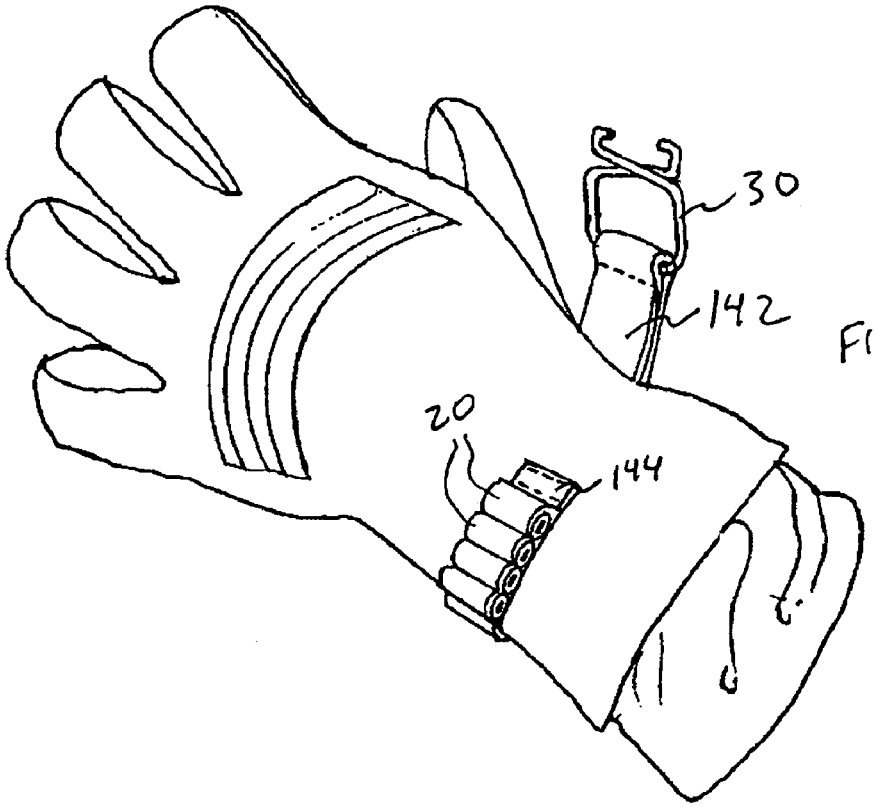

FIG. 15 depicts item 14 as a glove with wristband 142, which adjusts the fit around the user's wrist. Similar to adjustable waistband 120 shown in FIG. 12, wristband 142 includes clasp 30 that is selectively secured to any one of a plurality of receivers 20. As shown, the plurality of receivers 20 are attached to receiver strap 144 that is attached to wristband 142. In some embodiments, wristband 142 replaces receiver strap 144. It is understood that each glove may be substituted with a mitten and the invention would operate in similar fashion for the mitten.

Figure 16:
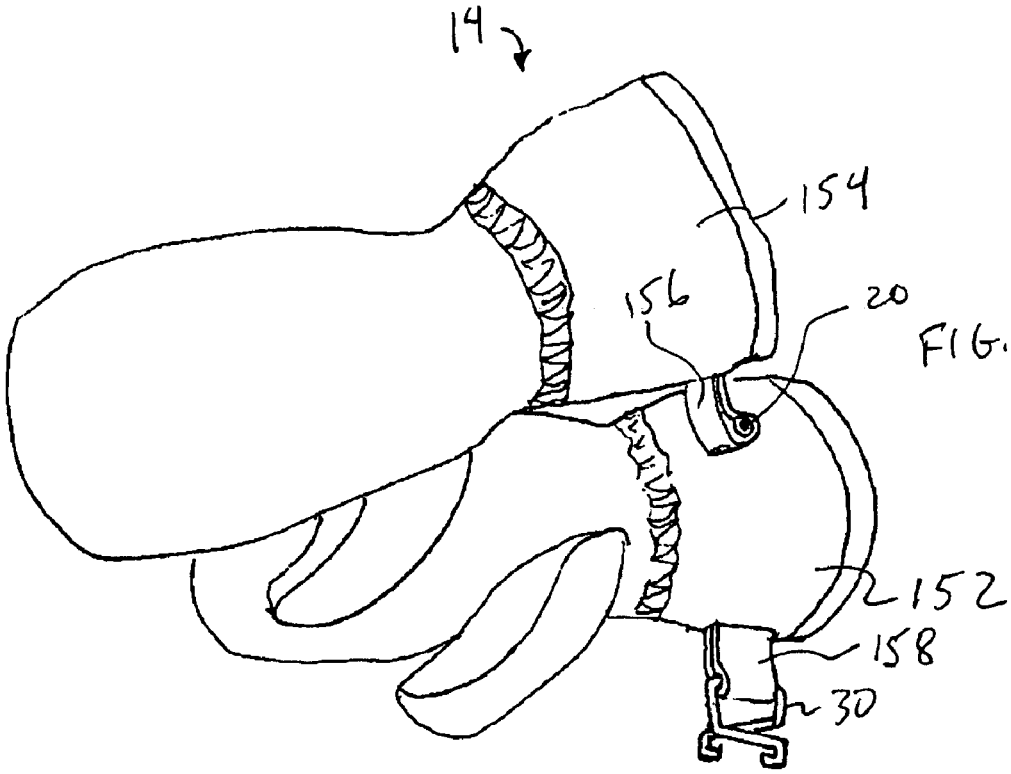

FIG. 16 shows item 14 as a pair of gloves where clasp 30 is attached to first glove 152 and receiver 20 is attached to second glove 154 where first glove 152 and second glove 154 may be connected to one another by engaging clasp 30 to receiver 20. This is advantageous when a wearer is no longer wearing the pair of gloves and connects them together to reduce a likelihood of misplacing the pair. In some embodiments, clasp 30 is attached to second glove 154 and receiver 20 is attached to first glove 152. As shown, receiver 20 is attached to receiver strap 156 which in turn is attached to second glove 154 and clasp 30 is attached to clasp strap 158 which in turn is attached to first glove 152.

Figure 17:
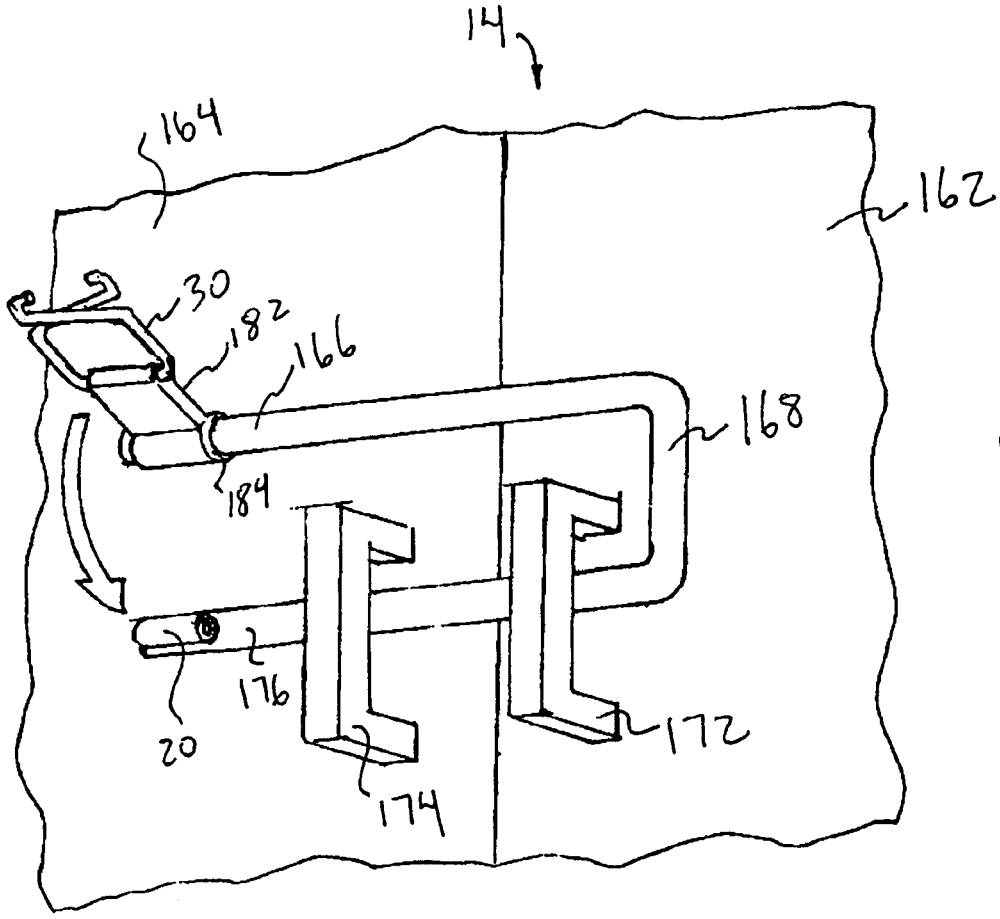

FIG. 17 depicts item 14 as a lock for locking first cabinet door 162 to second cabinet door 164. The lock functions by placing U bolt 168 through first handle 172 and second handle 174 and subsequently engaging clasp 30 with receiver 20, where clasp 30 is rotatably secured to one side 166 of U bolt 168 and receiver 20 is attached to opposite side 176 of U bolt 168. As shown, clasp 30 is attached to rigid clasp strap 182 that is in turn secured to cylinder 184 and where cylinder 184 is positioned around a diameter of one side 166. In further embodiments, clasp 20 or rigid clasp strap 182 is attached to a bushing or bearing.

Figure 18:
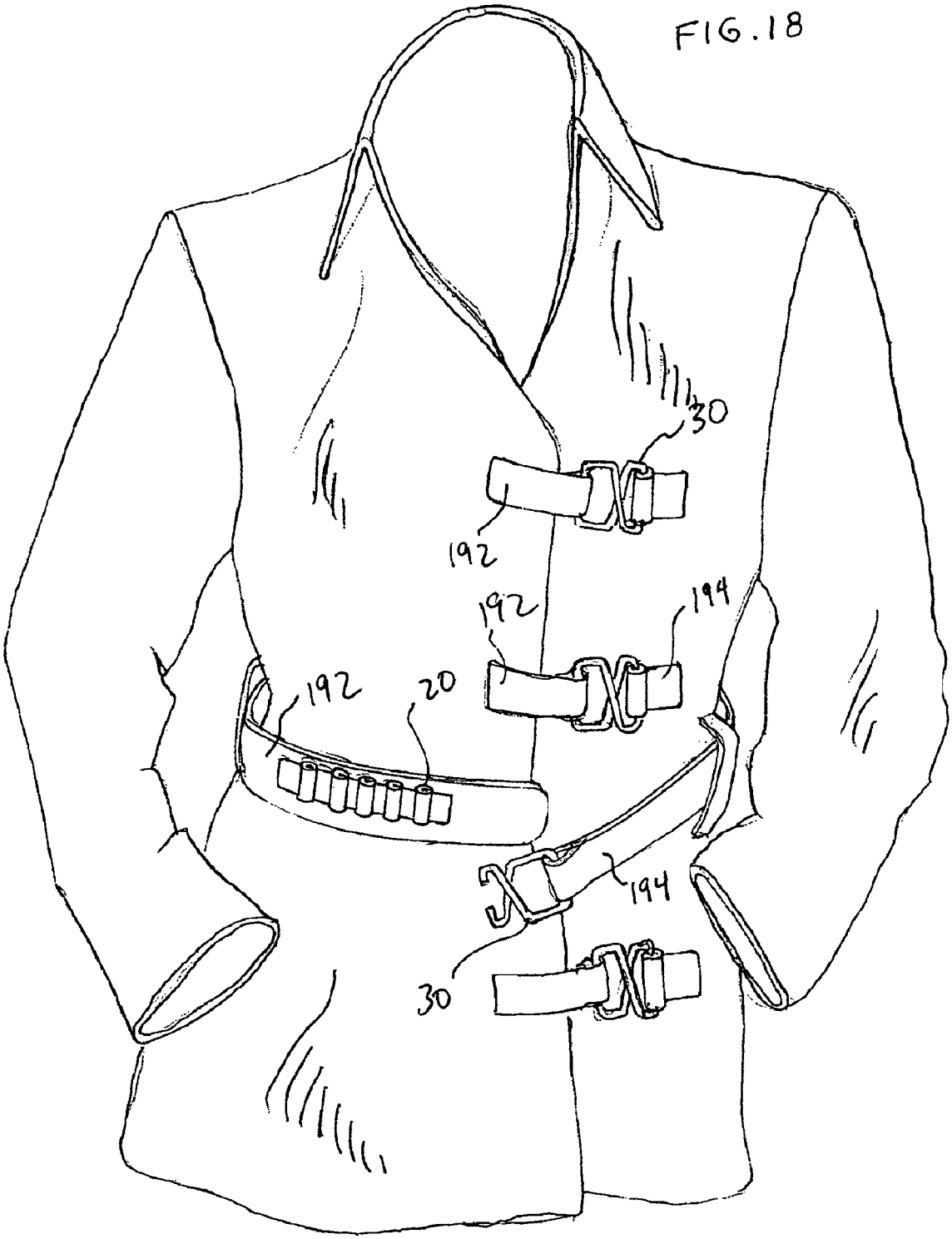

FIG. 18 depicts item 14 as a jacket where clasp 30 and receiver 20 are used instead of a zipper or button. As shown a plurality of clasps and receivers are used. In addition, the jacket includes an adjustable waistband that operates in similar fashion to the waistband of FIG. 12. To facilitate attachment of clasp 30 and receiver 20 to the jacket, receiver 20 is attached to receiver strap 192 and clasp 30 is attached to clasp strap 194, both of which are attached to the jacket.

Although the invention has been described with reference to particular arrangements of parts, features and the like, these are not intended to exhaust all possible arrangements or features, and indeed many other modifications and variations will be ascertainable to those of skill in the art.

What is claimed is:

1. A closing system, comprising:

an item to be closed and opened;

a clasp having an anchoring end and a lace end, said lace end adapted to hold a part of the item;

said anchoring end having a first part and a second part where said first and second parts are movable away from and toward one another;

a receiver having a first receptacle and a second receptacle for engaging said first and second parts, respectively;

wherein said clasp is removably joinable to said receiver when said first and second parts are engaged with said first and second receptacles and, when said first and second parts are disengaged with said first and second receptacles, said clasp is separable from said receiver;

wherein said first and second parts are, when an opening force is applied to said clasp, moved away from one another;

wherein said receiver is removably attachable to said item;

wherein said receiver is selected from the group consisting of a button and a hook; and wherein said item is selected from the group consisting of a belt and a cabinet.

2. The closing system according to claim 1, wherein said button is a snap button.

3. The closing system according to claim 1, wherein said button is insertable.

4. A closing system, comprising:

an item to be closed and opened;

a clasp having an anchoring end and a lace end, said lace end adapted to hold a part of the item;

said anchoring end having a first part and a second part where said first and second parts are movable away from and toward one another;

a receiver having a first receptacle and a second receptacle for engaging said first and second parts, respectively;

wherein said clasp is removably joinable to said receiver when said first and second parts are engaged with said first and second receptacles and, when said first and second parts are disengaged with said first and second receptacles, said clasp is separable from said receiver;

wherein said first and second parts are, when an opening force is applied to said clasp, moved away from one another;

wherein said receiver is removably attachable to said item; and wherein said receiver includes at least a portion of a hook and loop fastener.

5. The closing system according to claim 4, wherein said first and second parts are biased toward one another such that, when the opening force is removed, said first and second parts automatically move toward one another.

* * * * *